United States Patent [19]

Matheisen

[11] Patent Number: 4,669,724

[45] Date of Patent: Jun. 2, 1987

[54] PHYSICAL TRAINING APPARATUS

[76] Inventor: Hans W. Matheisen, Mycross House, Union Hall, County Cork, Ireland

[21] Appl. No.: 678,888

[22] PCT Filed: Apr. 5, 1984

[86] PCT No.: PCT/EP84/00098

§ 371 Date: Dec. 6, 1984

§ 102(e) Date: Dec. 6, 1984

[87] PCT Pub. No.: WO84/03834

PCT Pub. Date: Oct. 11, 1984

[30] Foreign Application Priority Data

Apr. 6, 1983 [DE] Fed. Rep. of Germany ..... 3312335
Apr. 26, 1983 [DE] Fed. Rep. of Germany ..... 3314975

[51] Int. Cl.[4] ..... A63B 17/00

[52] U.S. Cl. ..... 272/145; 272/DIG. 4; 128/15

[58] Field of Search ..... 272/144, 145, DIG. 4; 128/25 R, 71, 72, 73, 74, 75, 69–70; 269/325, 326, 328

[56] References Cited

U.S. PATENT DOCUMENTS 885,243 4/1908 Haas ..... 128/75
1,626,091 4/1927 Macklin ..... 128/74 X
3,492,988 2/1970 De Mare ..... 128/25 R X
3,760,801 9/1973 Borgeas ..... 128/25 R
3,790,164 2/1974 Flanigan ..... 272/145
4,114,613 9/1978 Kuhn ..... 128/71 X
4,232,662 11/1980 Barber ..... 128/71
4,494,533 1/1985 Sgroi et al. ..... 128/75

FOREIGN PATENT DOCUMENTS 0033558 8/1981 European Pat. Off. ..... 269/325
2854142 6/1980 Fed. Rep. of Germany ..... 272/144

*Primary Examiner*—Richard J. Apley
*Assistant Examiner*—Robert W. Bahr
*Attorney, Agent, or Firm*—Horst M. Kasper

[57] ABSTRACT

A physical training apparatus comprising an L-shaped supprt (1) having a beam (4) pivotable about a horizontal axis. The beam (4) carries supports for the body including trunk supports (5, 6) footrests (8) and handles (7), where the right and left trunk supports (5*a*, 5*b*, 6*a*, 6*b*), footrests (8*a*, 8*b*) and handles (7*a*, 7*b*) are independently adjustable along the beam (4). Furthermore, the beam (4) is adjustably attached to a crank arm (22) through a bracket (3) for varying the distance between the beam (4) and the oscillation shaft (17).

22 Claims, 21 Drawing Figures

FIG. 14
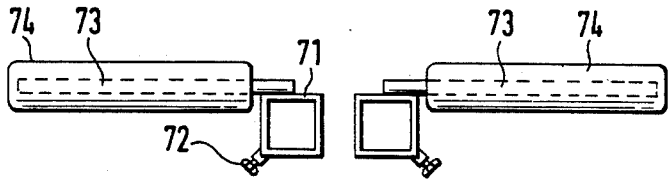
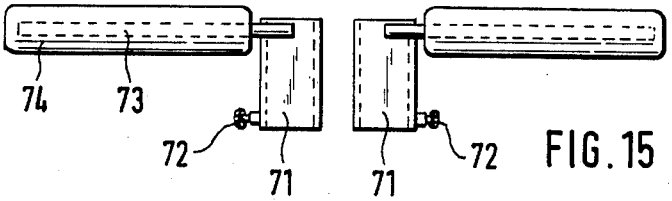
FIG. 15
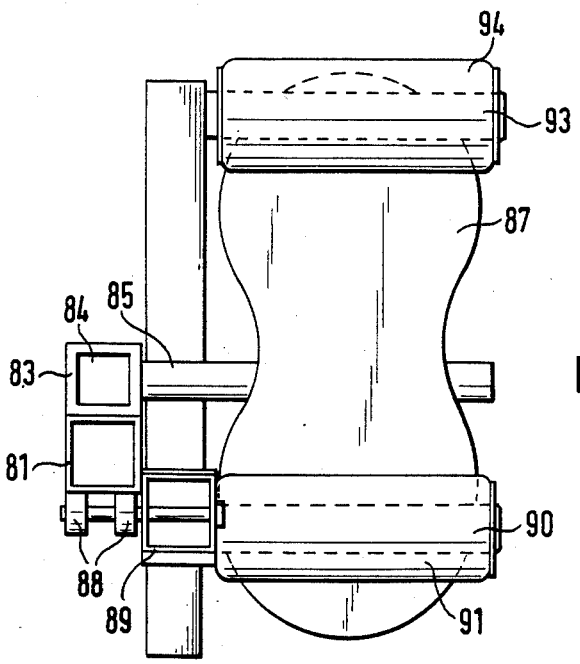
FIG. 16

FIG. 19
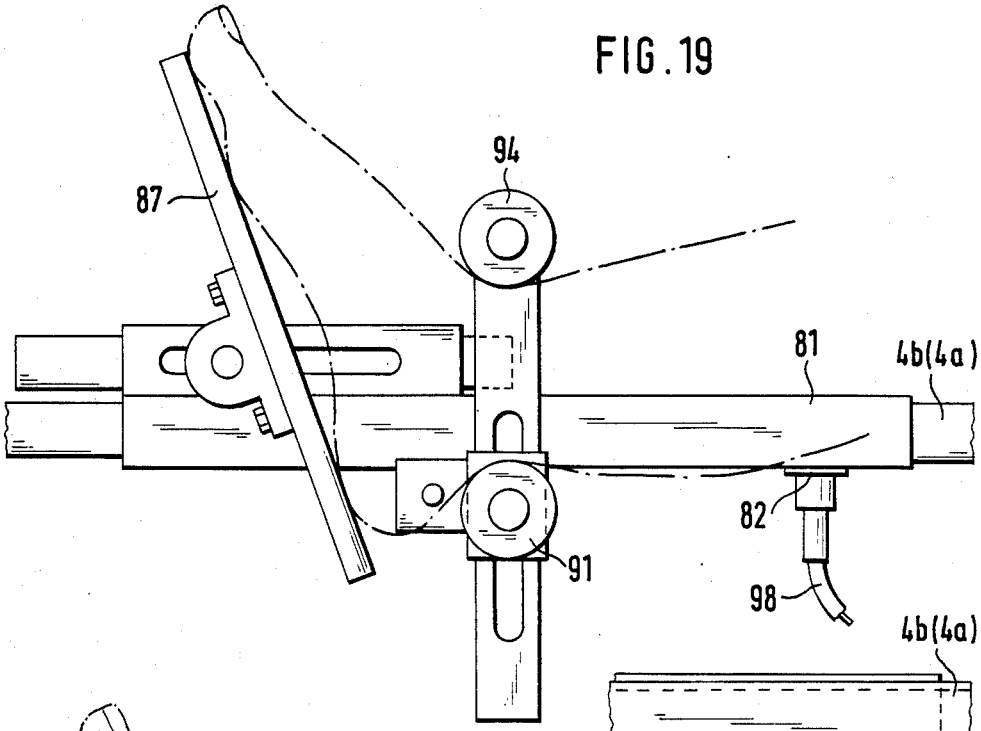
FIG. 20
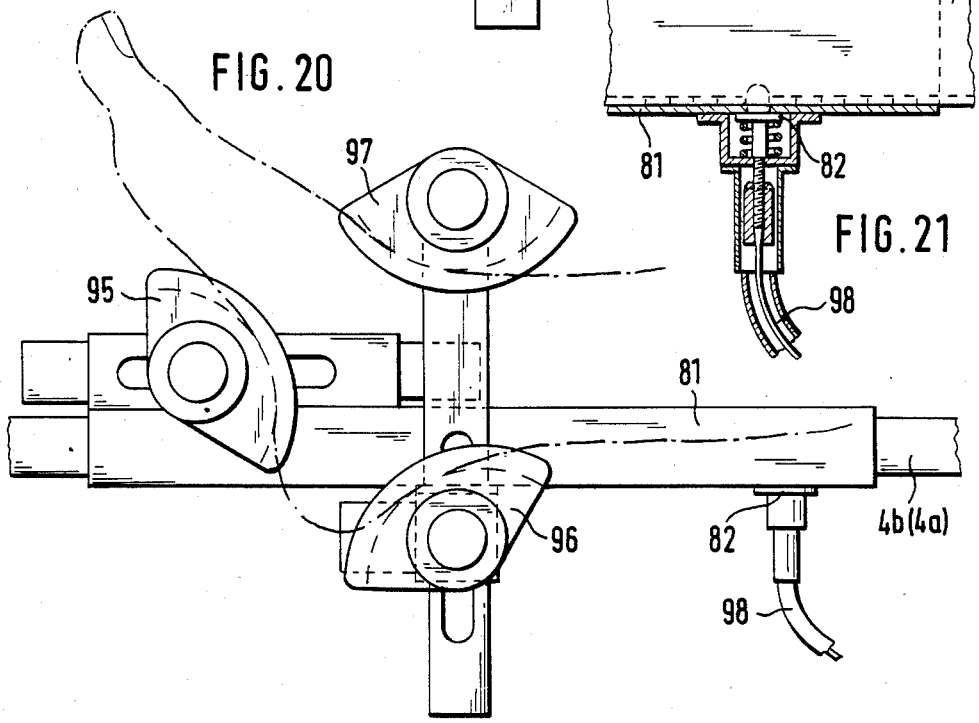
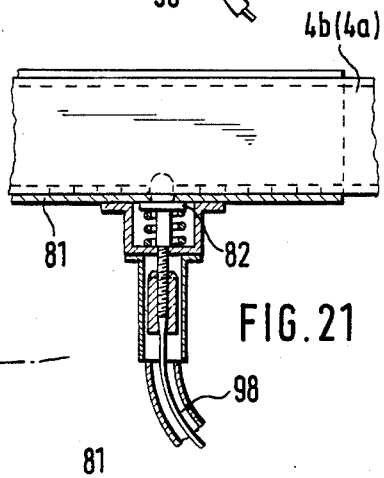
FIG. 21

PHYSICAL TRAINING APPARATUS

CROSS-REFERENCE TO RELATED APPLICATIONS

This application is a continuation-in-part application of another international application filed under the Patent Cooperation treaty Apr. 5, 1984 bearing Application No. PCT/EP84/00098, and listing the United States as a designated country. The entire disclosure of this application, including the drawings thereof, is hereby incorporated in this application as if fully set forth herein.

BACKGROUND OF THE INVENTION

1. Field of the Invention

The present invention relates to a physical training apparatus which comprises a stand and a bar rotatable around a horizontal axis with a dropped axis, where the distance of the bar relative to the rocker axis can be changed.

2. Brief Description of the Background of the Invention Including Prior Art

A physical training apparatus is employed for the full training of muscles and joints and of the human breathing and motion organs. It can comprise a stand and a bar tiltably disposed at the stand, where the bar is provided with body support provisions (hip and upper body supports), foot supports and handlebars. The dropped axis of the bar can be provided with an adjustable distance of the bar relative to the tilting axis such that the bar with resting body can be maintained at an indifferent balance position (U.S. Pat. No. 2,566,351, U.S. Pat. No. 3,794,023, German Patant Application Laid Open DE-OS No. 2,854,142, European Patent Application EP-Al No. 0,093,387).

The use of the conventional apparatus of this kind is made difficult by the constructional configuration of such apparatus as well as by the coaching of the user by an instructor, since the anomalies in the body shape of the user as well as an easy accessibility to the apparatus for the user and the coach have not been considered.

SUMMARY OF THE INVENTION

1. Purposes of the Invention

It is an object of the present invention to provide an improvement of the conventional physical training apparatus relative to their adaptation and accessibility for the user. It is a further object of the present invention to provide a physical training apparatus where the feet rest firmly, and the handlebars can be individually adjusted in their relative position.

It is a further object of the present invention to provide a physical training apparatus where the right hand side and the left hand side can be individually adapted to the specific requirements of the user by separate mechanisms.

These and other objects and advantages of the present invention will become evident from the description which follows.

2. Brief Description of the Invention

The present invention provides a body training apparatus comprising a stand, a bar supported by the stand tiltable around a horizontal dropped axis, means for changing the distance of the bar to the horizontal axis, support means for the body at the hip and the upper trunk and support means for the feet and the hands. These spport means are adjustable along the bar, and the support means on the right and left side of the training body are separately adjustable along the longitudinal direction of the bar.

The body training apparatus can have a right and a left foot support means which are separately adjustable as to their respective longitudinal position along the bar. Each foot support part can comprise a foot sole support tiltable crosswise to the foot, which foot sole support can be provided with a rotary support at a distance to the support surface which can be shorter than the radius of curvature of the foot support surface. Each foot support part can further comprise two additional supports for the foot which engage the foot above the instep and above the heel, respectively, and which can be supported by a yoke and can be adjusted in their relative position. The yoke can be tilted and adjusted in its relative position to the foot sole support. Each foot support part can further comprise remote controlled means for arresting the position of the foot support means relative to the bar. The remote control means for arresting the position can be provided by a Bowden cable.

The body training apparatus can have a right and a left handlebar support means which are separately adjustable as to their respective longitudinal position along the bar.

The body training apparatus can have a right and a left upper trunk support means which are separately adjustable as to their respective longitudinal position along the bar. A right and a left hip support means can also be separately adjustable as to their respective longitudinal position along the bar. The hip support means can comprise a pad which is adjustable by the insertion of inflatable bodies for adjusting the distance of the pad surface from the bar. The pad can be subdivided in sections, which can be individually adjusted as to their cross-section with the use of inserted inflatable bodies. The right and the left hip support can be tilted around respective axes running parallel to the bar up to providing about a V-shape for forming a support surface adapted to the form of the training body.

The bar of the body training apparatus can comprise a right and a left ledge for guiding and attachment of the support means for the training body, which is separate for the right and left hand side. The bar can be provided as two separate beams supported about at their middle position with a crossarm. The crossarm supporting the bar can be formed as a crank attached to the arm of a rocker mounted to the stand, which rocker is tiltably disposed at the bracket shape stand of the apparatus and tilts around a horizontal axis.

The stand of the body training apparatus can be formed like an L or a C supporting the rocker.

The bearing for the rocker between stand and bar can be provided with stop means for limiting the range of rotary motion versus a horizontal base position of the bar. The bearing can also be provided with resilient delay means for limiting the elongation range of rotary motion versus a horizontal base position of the bar.

The right and the left foot supports and/or the right and left handlebars and/or the right and left body support pads (hip and upper trunk pads) are separate according to the invention and they can be individually adjusted along the bar. Thus they can be adapted to the anomalies of the body of the individual user.

In order to achieve a separate adjustability of foot supports, handlebars and body supports along the bar in a simple way, according to a feature of the invention the bar is provided with a right and a left ledge for guiding and catching in each case the right and left foot support, the right and left handlebar and the right and left body support means. Instead of the right and left ledges at the bar, there can also be employed two separate bars held together only by, for example, a support arm at about the middle of their length.

According to a further feature of the invention, the support arm of the bars is provided as console bracket, which can be adjusted along the arm of a rocker, where the rocker support can be provided by the stand of the apparatus, which has a C or L shape and supports the tilting rocker. The one side flying support of the bar or, respectively, the bars with the support arm provided as a bracket enhances the accessibility of the apparatus decisively, which is an advantage for handicapped users of the apparatus as well as for a trainer coaching the user. Thus a further object of the invention is achieved.

The adaptability of the physical training apparatus to anomalies in the body shape achieved by the separate adjustability of the foot supports, the body supports and the handle bars can be further achieved according to the invention by tilting the right and left hip supports along an axis disposed parallel to the bar such that they can provide a support surface of about V shape and adapted to the form of the body.

The hip supports can overall or from the middle to the side be subdivided and can be adjusted by inflatable bodies at a distance from the support surface relative to the bar and/or in their cross section. These inflatable bodies can be provided by themselves or in connection with the tiltability of the hip supports around an axis disposed in parallel to the bar.

Each of the foot supports can, in addition to the separate adjustability for improving the adaptability, be comprised of a support for the sole of the foot, which is tiltable at a pivot bearing disposed at a shorter distance relative to the support surface compared with the radius of curvature of the support surface and which is disposed crosswise to the foot. The foot sole support can be coordinated to further foot supports disposed above the heel and above the instep, where the two additional foot supports are supported by a yoke which allows the adjustment of their relative positions to each other and which can be tiltable such that the additional foot supports can be adjusted in their position relative to the support of the sole of the foot.

The readjustment and setting of the foot parts is generally considered difficult by the user of the apparatus and sometimes is even too difficult for outside help to achieve. In order to alleviate this deficiency, the present invention provides a further feature of an arresting and stopping provision in order to arrest the foot parts versus the bar. The arresting and stopping provision can be provided with a remote control such as for example a Bowden cable, such that the use of the apparatus can provide the adjustment or, respectively, free adjustment of the foot parts accurately and without exertion from the most favorable or respective positions. The possibility of remote adjustment is of a particular advantage for certain exercises at the apparatus, which require a drawing up of the leg toward the body.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 14 is an elevational view of the handlebar, FIG. 15 is a plan view of the handlebar support, FIG. 16 is an elevational view of the foot support provision, FIG. 19 illustrates the positioning of a foot in the foot support provision, FIG. 20 is a view of a further embodiment of the foot support provision, FIG. 21 is a view of the remote adjustable provision for the foot support means.

DESCRIPTION OF INVENTION AND PREFERRED EMBODIMENT

Figure 1:
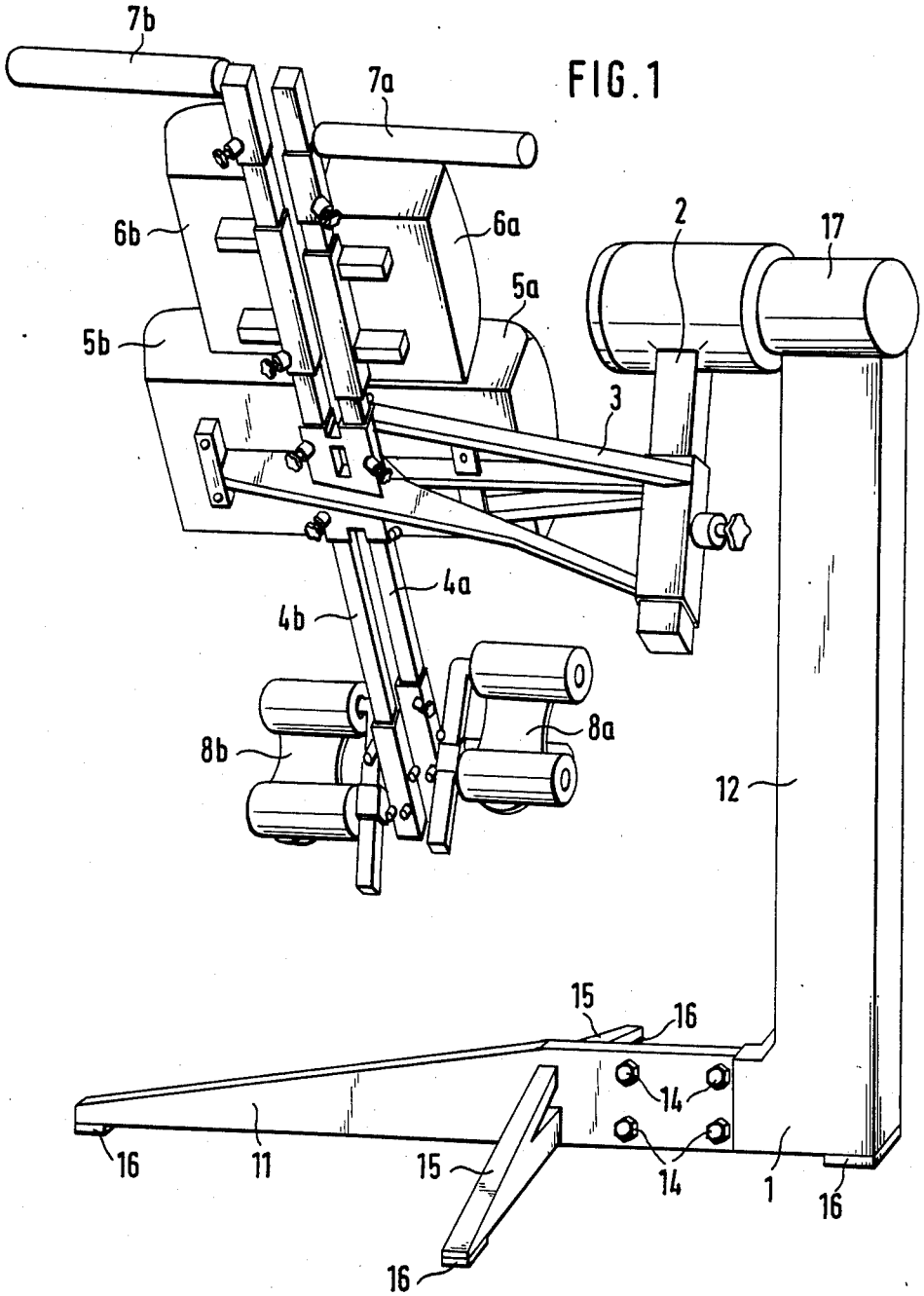
FIG. 1 is a perspective view of a physical training apparatus according to the invention.

In accordance with the present invention, there is provided a physical body training apparatus which comprises a stand 1, which supports a bar 4 attached to a crank which can rotate around a horizontal axis fixed relative to the stand, where the distance from the bar 4 to the tilting axis 17 can be changed and where the bar provides for body support means for hips and upper body 5, 6, foot supports 8 and handlebars 7, which are attached to the bar 4 and can be adjusted along said bar. In particular, the right and left foot support 8*a*, 8*b* and/or the right and left handlebar 7*a*, 7*b* and/or the right and left body support provisions 5*a*, 6*a*, 5*b*, 6*b* are separated and can be individually and separately adjusted along the bar 4. Preferably the bar 4 is provided with right and left ledges for the guiding and attaching of the respective right and left foot support, body support, and/or handlebar.

Two separate bars 4*a*, 4*b* can be provided, which are attached via a support arm disposed at about their middle. The support arm 3 of the bar 4, or respectively, the bars 4*a*, 4*b* can be adjustably provided as a bracket along the arm 22 of a rocker 2. The stand 1 of the apparatus can have a C or L shape such that it provides the horizontal axis 17 for the rocker. The right and left hip support means 5*a*, 5*b* can be tilted around axis 53 parallel to the bar 4, which allows the hip support surface to be adapted to the body shape up to about V shape. The hip supports 5*a*, 5*b* can be adjusted overall from the middle to the side in sections I, II, III, IV individually by inflatable bodies for adjusting the distance of the support surface relative to the bar 4 or for adjusting their cross sectional profile.

Each foot part 8*a*, 8*b* can comprise a support 87, 95 for the sole of the foot. The support for the sole of the foot can have a rotary bearing support which has a lesser distance to the support surface as compared with the radius of curvature of the supprt surface. The foot sole support can be tiltably disposed crosswise to the foot. The support of the sole of the foot 87, 95 can be provided with two additional supports disposed above the heel 91, 96 and the instep 94, 97 of the foot, which supports are mounted to a yoke 92, are adjustably disposed relative to each other and can be tilted together with the yoke 92 and thus adjusted in their distance relative to the support 87, 95 of the sole of the foot.

An arresting provision of the foot parts 8*a*, 8*b* with respect to the bar 4 or, respectively, the right and left bar 4*a*, 4*b* can be coordinated to the right and left foot part 8*a*, 8*b*. This arresting provision can be remotely controlled and in particular can employ a Bowden cable 98.

The tilting bearing 21 between the stand 1 and the bar 4 can be provided with adjustment means for a limiting 201 to 211 of the elongation of the tilting versus a horizontal base position of the bar and/or can provide a delay 220 to 225 of the rocking motion.

Referring now to FIG. 1, the physical body training apparatus comprises a stand 1, to which a rocker is tiltably disposed. A support arm 3 is attached at the arm of the rocker 2 and is adjustable with respect to the distance to the rocker axis. The support arm carries two bars 4*a*, and 4*b*. The arm 3 with the bars 4*a* and 4*b* serves as a carrier of body supports, that it, the hip rest 5*a* and 5*b* and the upper trunk rest 6*a* and 6*b*, and further serves as the support for handle bars 7*a* and 7*b* and for foot support rests 8*a* and 8*b*.

In the accompanying drawings, the parts on the right hand side are designated in each case with a and the parts on the left hand side are designated in each case with b for mirror imaged component parts of the same reference numeral.

Figure 2:
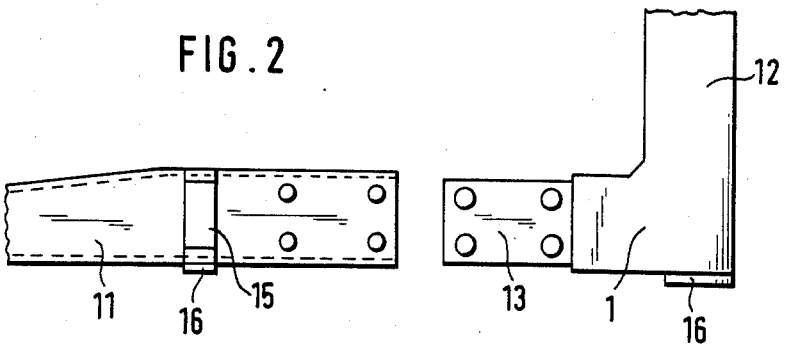
FIG. 2 is an elevational view of parts of the stand.
Figure 3:
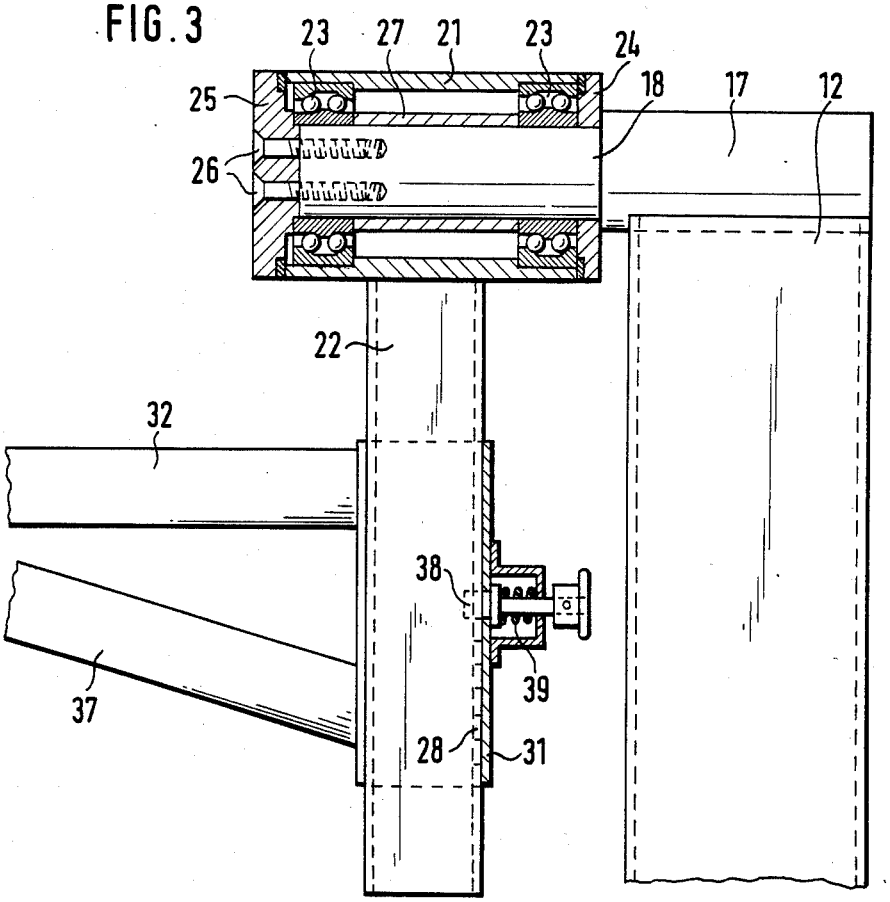
FIG. 3 is an elevational and in part sectional view of the rocker provision of the physical training apparatus.
Figure 5:
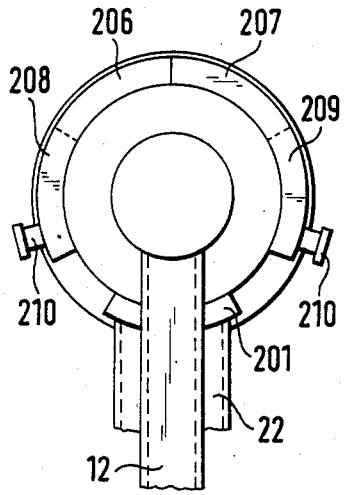
FIG. 5 is a side view of the rocker shown in FIG. 4.
Figure 4:
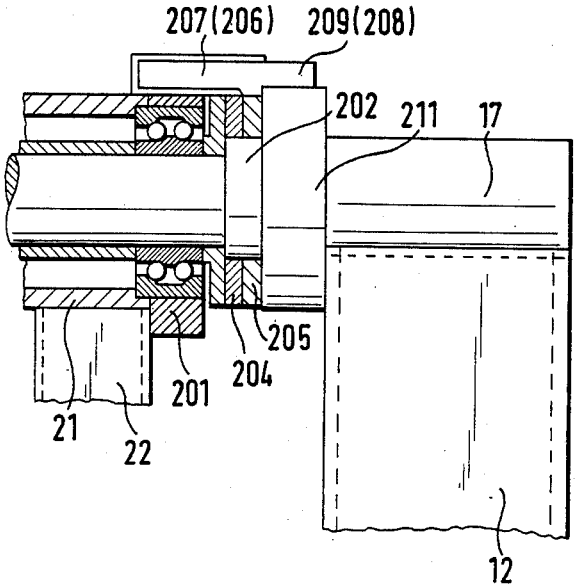
FIG. 4 is a partly elevational and partly sectional view of the attachment of the rocker to the stand.
Figure 7:
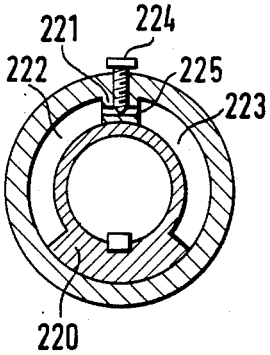
FIG. 7 is a sectional view of the embodiment of FIG. 6.
Figure 6:
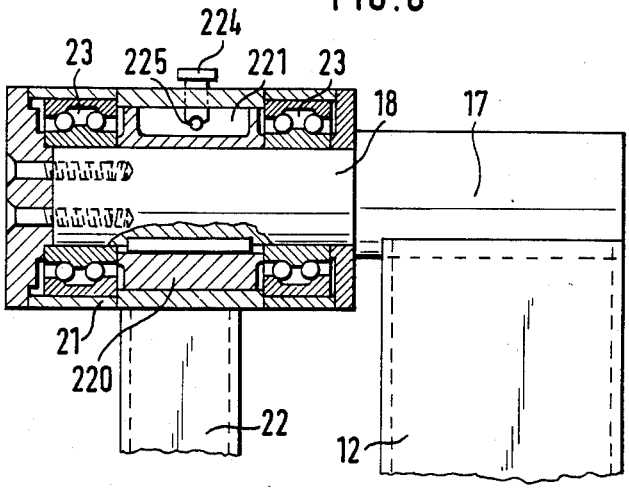
FIG. 6 is a view similar to that of FIG. 4 for a different embodiment.

As can be recognized in detail from FIGS. 2 and 3, the stand 1 comprises the stand foot 11 and the stand column 12. The stand column 12 is provided with a tenon pin 13, with which it can be inserted into the tubular end of the stand foot 11 and is connectable via screws 14 to this stand foot. The stand foot 11 is provided with cross web 15. The stand contacts the floor with floor plates 16, one of which at least can be adjusted for balancing on an uneven floor. The stand column 12 is provided at its upper end with a shaft 17, and the rocker 2 is tiltably disposed on shaft section 18.

As can be recognized from FIG. 3, the rocker 2 is formed by a bearing head 21 and arm 22 attached to it. Two row angular ball bearings support the rocker tiltably on section 18 of the shaft 17 at the stand column 12 of the stand 1. The angular ball bearings 23 are inserted with their outer rings into bores of the bearing at 21 of the rocker 2. The inner rings of the angular ball bearing 23 are attached at the shoulder 18 of the shaft 17 between the ring 24 terminating the bearing head 21 on one side and the disk 25 terminating the bearing head on the other side, which disk 25 is attached with screws 26 to the shaft 17. The spacer bushing 27 is disposed between the inner rings and the angular ball bearing 23.

Figure 8:
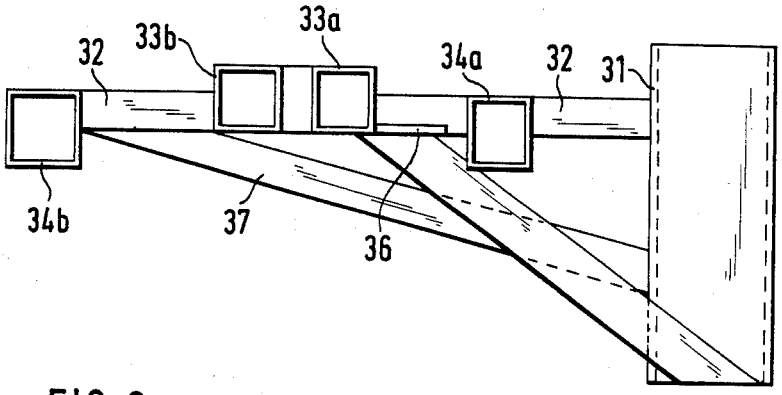
FIG. 8 is an elevational view of the attachment of the bars to the rocker arm.
Figure 9:
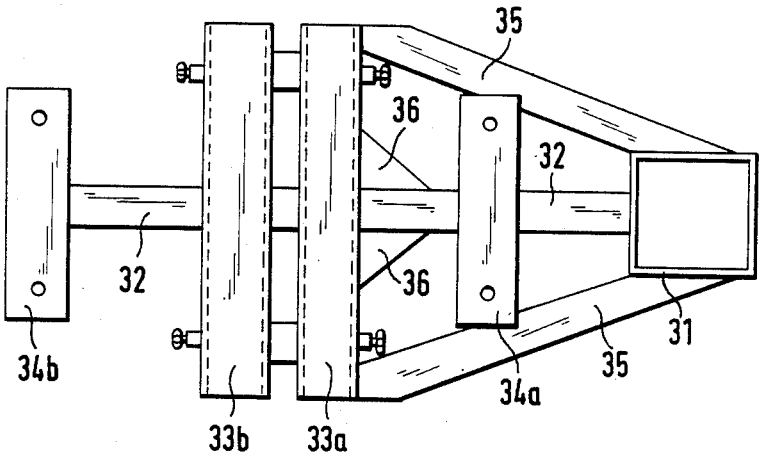
FIG. 9 is a plan view of the embodiment of FIG. 8.

The support arm 3 is attached at the arm 22 of the rocker 2 at a distance to the tilting axis provided by shaft 17 and shoulder 18 in an adjustable way. The support arm 3 carries as a bracket the bars 4*a* and 4*b*. As can be recognized in particular from FIGS. 8 and 9 illustrating the support arm 3, the support arm 3 comprises a sliding tube 31 along which the arm 22 of the rocker 2 is adjustably guided. Web 32 connects the sliding tube 31 with runner sleeves 33*a* and 33*b* for the bars 4*a* and 4*b* as well as with attachment pieces 34*a* and 34*b* for the hip support provisions 5*a* and 5*b*. Side webs 35, gussets 36, as well as support webs 37 are provided for stiffening of the web 32. A locking bolt 38, which is placed under the pressure of the spring 39 and which can be moved outwards against the spring force, can arrest and stop the support arm 3 at the arm 22 of the rocker 2 at a desired distance relative to the tilting axis as is illustrated in FIG. 3. The arm 22 is provided for this purpose with a sequence of holes 28, where the holes serve as rest positions for the stop bolt 38.

Figure 10:
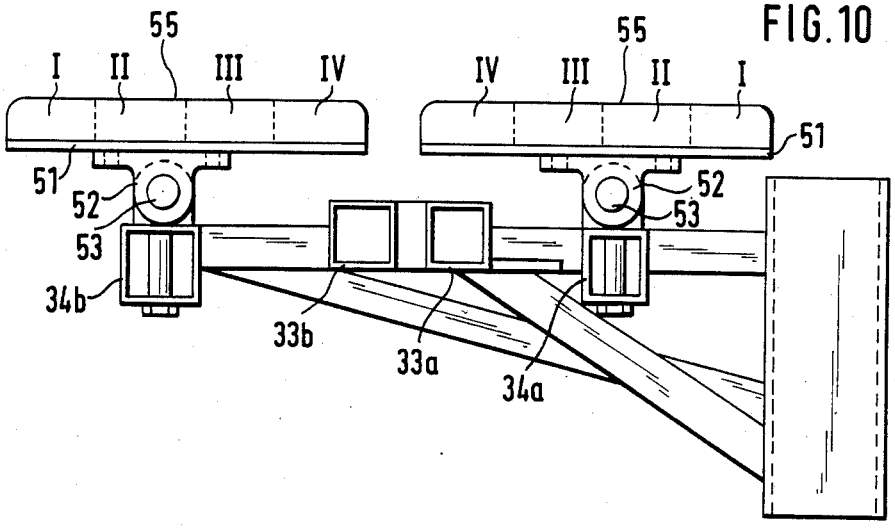
FIG. 10 is a view similar to that of FIG. 8 together with the body support provisions.
Figure 11:
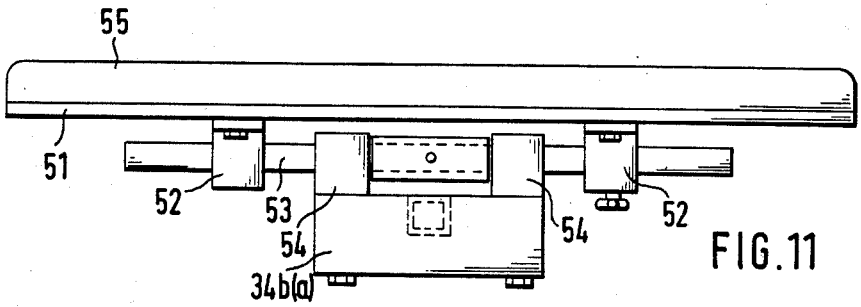
FIG. 11 is a side view of the hip support provision.

The formation of the hip supports 5*a* and 5*b* is illustrated in FIGS. 10 and 11. They comprise support boards 51 which can be adjusted with supports 52 along the tilting axis 53 and can be fixed in their positions relative to the tilting axis 53. Bearing blocks 54 disposed at the attachment pieces 34*a* and 34*b* support the tilting axis 53 in an axial, nonshiftable but rotatably movable position. The support boards 51 with the cushion pads 55 thus can freely adjust their position and can form up to a V shape support surface. As is indicated in FIG. 10, the upholstery pads 55 can be subdivided in sections I, II, III, IV over the width, and inflatable bodies can be contained in these sections, which can be inflated independently from each other and to a different extent. This allows one to additionally influence the profile of the support surface and its distance from the tilting axis. However, it is also possible when of inflatable bodies are used in the upholstery pads 55, to connect the support boards 51 directly and fixably with the attachment pieces.

Figure 12:
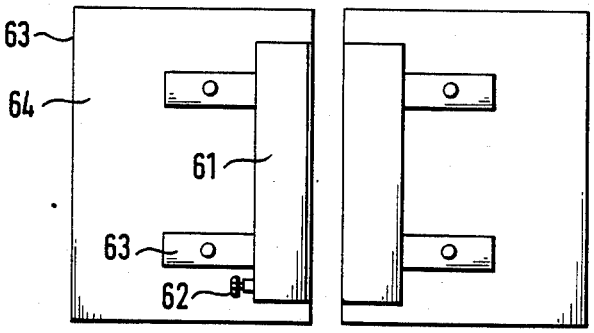
FIG. 12 is a schematic plan view of the upper trunk support provision.
Figure 13:
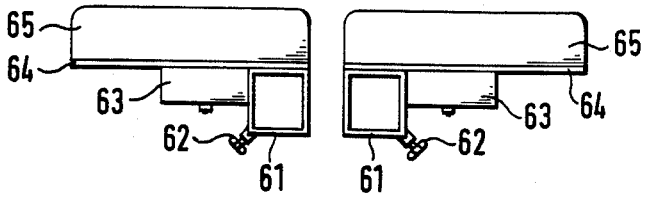
FIG. 13 is an elevational view of the embodiment of FIG. 12.
Figure 17:
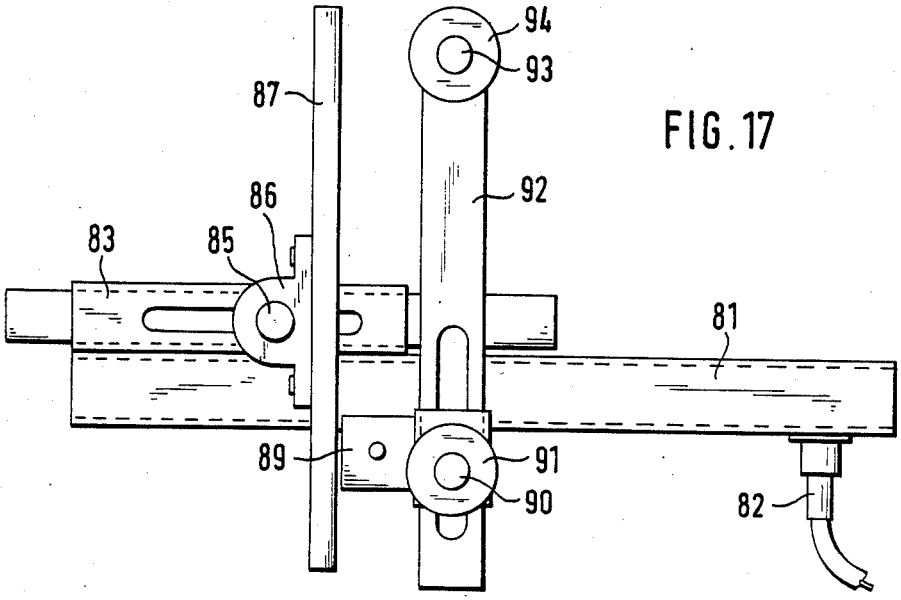
FIG. 17 is a detailed view of the foot support provision.
Figure 18:
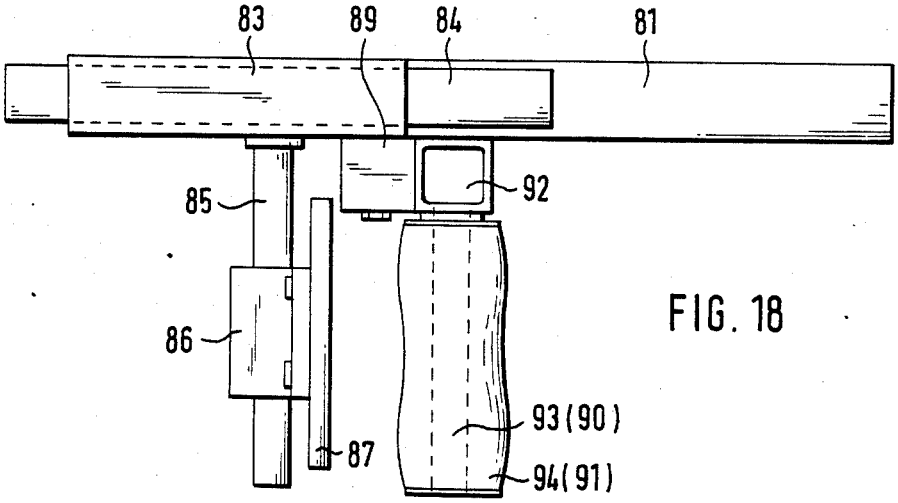
FIG. 18 is a further view of the foot support provision along the plane of the foot support surface.

FIGS. 12 and 13 show the formation of the upper trunk supports 6*a* and 6*b*. They comprise a sliding tube 61 with which they can be adjusted along the bars 4*a* or, respectively, 4*b*, and they can be fixed in their position relative to the bars 4*a* and 4*b* with the clamping screw 62. Claws 63 welded to the sliding tubes 61 support the support boards 64 with the upholstery pads 65.

Even though the upper trunk support can in most cases be provided in a simple fashion as in the embodiment shown, it is in principle possible to provide the hip support and the upper trunk support in one and a different way or both in the same manner.

The handlebars 7*a* and 7*b* comprise sliding tubes 71 as can be recognized in FIGS. 14 and 15. The handlebars 7*a* and 7*b* can be adjusted along the bar 4*a* or, respectively, 4*b* and can be fixed versus this bar with clamping screws 72. Handlebars 73 are welded to the sliding tubes 71. the handlebars can be surrounded by cushion pads 74.

FIGS. 16 to 19 show in detail the foot supports 8*a* and 8*b*, while a different embodiment is shown in FIG. 20, and FIG. 21 shows a detail in enlarged scale. Each foot support 8*a*, 8*b* comprises a sliding tube 81 which can be adjusted along the bar 4*a* or, respectively, 4*b* and which can be fixed at a desired position with locking provision 82. The sliding tube 81 is connected with a guide 83 disposed in parallel to it, wherein a sliding piece 84 is longitudinally shiftable and fixable at a desired position. The sliding piece 84 carries a support rod 85. The support rod 85 carries with a pivot bearing 86 a foot support board 87 for supporting the sole of the foot. The foot support board 87 is provided with a skid pad of rubber sponge or similar material. Furthermore, to the sliding tube 81 there are attached bearing eyes 88, which support a cross piece 89 which can be tilted in the bearing eyes 88. The cross piece carries a support rod 94 for a roller 91 as a foot support engaging above the heel. The yoke 92 is adjustable and fixable in its position in the cross piece. A further support rod 93 can be disposed at the free end of the yoke 92 for a further roller 94 engaging the instep of the foot. It can be recognized from FIG. 19 how a foot is supported between the support board 87 and the support rollers 91 and 94 and can nevertheless maintain the required freedom of motion. As shown FIG. 20, segment pieces 95, 96 and 97 which are provided with soft or foam rubber pads can be used instead of the support board and the support rollers. In order to achieve a stable support of the sole of the foot on the segment piece 95 and stable support of the the segment pieces 96 and 97 at the heel and the instep of the foot, the second pieces are dimensioned such that the radius of curvature R of its support or, respectively, rest position is larger than the distance r of the tilting axis from this surface.

The arresting provisions 82 of the foot supports 8*a* and 8*b* are actuated via Bowden cables 98 such that the arresting of the foot supports can be performed by the user himself while placed extended on the physical training apparatus.

It will be understood that each of the elements described above, or two or more together, may also find a useful application in other types of physical training apparatus differing from the types described above.

While the invention has been illustrated and described as embodied in the context of a physical training apparatus it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the applied claims:

1. A body training apparatus comprising a stand having a substantially horizontal foot support part and a substantially vertical support column forming an L-shape;

a rocker tiltably connected to one side of the support column above the foot support part;

a bar connected to the rocker and being tiltable around a horizontal dropped axis, where the bar includes means for adjusting the position of the bar along the rocker, thereby changing the distance of the bar to the horizontal axis; and support means mounted on the bar including hand support means and foot support means for supporting the hands and feet of a training body, the hand and foot support means being separately adjustable on the right and left side of the training body in their position along the longitudinal direction of the bar.

2. The body training apparatus according to claim 1 wherein each foot support means comprises a foot sole support tiltable crosswise to the foot support means, which foot sole support is provided with a rotary support at a distance to a support surface which is shorter than the radius of curvature of the foot support surface.

3. The body training apparatus according to claim 2 wherein each foot support means further comprises two additional supports for the foot engaging the foot above the instep and above the heel, respectively, which are supported by a yoke and can be adjusted in their relative position and where the yoke can be tilted and adjusted in its relative position to the foot sole support.

4. The body training apparatus according to claim 2 wherein each foot support means further comprises remote controlled means for arresting the position of the foot support means relative to the bar.

5. The body training apparatus according to claim 4 wherein the remote control means for arresting the position is provided by a Bowden cable.

6. The body training apparatus according to claim 1 wherein the right and the left hand support means are in the form of handlebars.

7. The body training apparatus according to claim 1 further comprising a right and a left upper trunk support means which are separately adjustable as to their respective longitudinal position along the bar.

8. The body training apparatus according to claim 1 further comprising a right and a left hip support means which are separately adjustable as to their respective longitudinal position along the bar.

9. The body training apparatus according to claim 8 wherein the hip support means comprises a pad which is adjustable by the insertion of inflatable bodies for adjusting the distance of the pad surface from the horizontal axis of the bar.

10. The body training apparatus according to claim 9 wherein the pad is subdivided in sections, which can be individually adjusted in their cross-section with inflatable bodies.

11. The body training apparatus according to claim 8 wherein the right and the left hip support can be tilted around respective axes running parallel to the bar up to providing about a V-shape for forming a support surface adapted to the form of the training body.

12. The body training apparatus according to claim 1 wherein the bar comprises a right and a left ledge for guiding and attachment of said support means for the training body, which is separate for the right and left hand side.

13. The body training apparatus according to claim 1 wherein the bar comprises two separate beams supported about at their middle position with a crossarm.

14. The body training apparatus according to claim 1 further comprising a crossarm supporting the bar formed as a crank attached to the arm of the rocker, which rocker is tiltably disposed at the bracket shape stand of the apparatus and which rocker tilts around a horizontal axis.

15. The body training apparatus according to claim 14 wherein the bearing for the rocker between stand and bar is provided with stop means for limiting the range of rotary motion versus a horizontal base position of the bar.

16. The body training apparatus according to claim 14 wherein the bearing for the rocker between stand and bar is provided with resilient delay means for limiting the elongation range of rotary motion versus a horizontal base position of the bar.

17. The body training apparatus according to claim 1 further comprising separate body supports for a right and for a left half of a human body, which body supports are connected to the bar individually adjustable along the bar.

18. The body training apparatus according to claim 1 further comprising two lath pieces attached on the side of the bar, where the support means include means for supporting the body of the trainer, the support means being separately adjustable on the right and left side of the training body.

19. The body training apparatus according to claim 1 further comprising a second bar forming together with the first bar a double bar, where the first bar and second bar are disposed side by side parallel to each other and where separately formed support means for a part of the human body are individually adjustable and furnished for one of the two halves of the human body.

20. The body training apparatus according to claim 1 further comprising an adjustable support arm for the bar provided with an arm supporting the bar.

21. A body training apparatus comprising a stand having a horizontal foot and a single column connected at an end of the foot, the upper end of the column having a bearing support;

a single arm rocker mounted on the bearing support and being tiltable about a horizontal axis substantially parallel to the foot of the stand, the arm rocker having a support arm extending over the foot of the stand;

a bar adjustably connected to the support arm and being perpendicular to the horizontal axis about which the arm rocker is tiltable, the distance from the bar to the horizontal axis being changed as the bar is adjusted along the support arm;

support means mounted on the bar including hip support means, upper trunk support means, hand support means and, feet support means for supporting the body of a trainer, where the hand and foot support means are separately adjustable on the right and left side of the training body in their position along the longitudinal direction of the bar.

22. The body training apparatus according to claim 21 an adjustable support arm for the bar adjustably connected with an arm of a rocker along the rocker arm and where the adjustable support arm is rotatable with the rocker around a horizontal axis of the rocker.

* * * * *